United States Patent [19]

Hasegawa

[11] 4,061,169

[45] Dec. 6, 1977

[54] APPARATUS FOR CUTTING OFF A THICKNESS OF WOOD OR VENEER FROM LOGS

[75] Inventor: Katsuji Hasegawa, Nagoya, Japan

[73] Assignee: Meinan Machinery Works, Inc., Ohbu, Japan

[21] Appl. No.: 710,468

[22] Filed: Aug. 2, 1976

[51] Int. Cl.[2] ..... B27L 5/02

[52] U.S. Cl. ..... 144/213; 144/209 R

[58] Field of Search ..... 144/209 R, 211, 212, 144/213, 214, 215, 321

[56] References Cited

U.S. PATENT DOCUMENTS

| | | | |
|---|---|---|---|
| 200,996 | 3/1878 | Fairchild | 144/213 |
| 437,039 | 9/1890 | Oncken | 144/213 |
| 463,888 | 11/1891 | Chapman | 144/211 |
| 2,163,372 | 6/1939 | Claxton et al. | 144/209 R X |

*Primary Examiner*—Harrison L. Hinson
*Assistant Examiner*—W. D. Bray
*Attorney, Agent, or Firm*—Blanchard, Flynn, Thiel, Boutell & Tanis

[57] ABSTRACT

An apparatus for cutting off a thickness of wood or veneer from a log, which apparatus uses a plurality of resilient pressing members formed as rollers for pressing the surface of the log during the cutting operation. Each roller has a plurality of edged members projecting from the periphery thereof, which edged members form a plurality of small cuts in the surface of the log prior to cutting of the thickness of wood or veneer therefrom.

5 Claims, 12 Drawing Figures

APPARATUS FOR CUTTING OFF A THICKNESS OF WOOD OR VENEER FROM LOGS

BACKGROUND OF THE INVENTION

The present invention relates to an apparatus for cutting off a thickness of wood or veneer from logs.

In cutting a log with a rotary veneer lathe or a slicer having a tangential knife to form veneer sheets, cracks are often observed to form ahead of the cutting edge of the knife. Due to the presence of such cracks, proper advance of the cutting edge through the log is prevented. As a result, the surfaces of the cut-off sheets are quite rough, and they are not of uniform thickness. In manufacturing plywood using these sheets as veneer, this phenomenon leads to degradation of the surface quality of the plywood. To solve this problem, a conventional type of veneer lathe or slicer employs a unitary pressing member such as a pressure bar. In cutting a rotating log, for example, this pressure bar is pressed against the peripheral surface of the log slightly ahead of the cutting edge of the tangential knife over the axial length of the log.

Usually, however, the log has a number of knars scattered therein. These knars are hard and fragile, and not as elastic as the rest of the log. Therefore, if the pressure bar pressing the log with an ordinary force encounters a knar, the knar resists and prevents the rest of the log from being pressed effectively. If, however, the pressing force of the bar is increased in order to press the rest of the log effectively, the resisting knar often reaches its breaking point, causing holes or cracks to form in the produced veneer sheets. This drawback is due to the fact that the log is pressed throughout its axial length by a unitary pressure bar.

In addition, a crude log, before it is cut, is not exactly cylindrical in shape because of the irregularities on its peripheral surface. On the other hand, the portion at which the pressure bar makes contact with the log's surface is straight and smooth. Therefore, the pressure bar does not always make contact with the log's surface while the knife cuts the log throughout its axial length. As a result, the pressure bar does not serve its intended purpose until the cutting provides the log with an exact cylindrical shape.

SUMMARY OF THE INVENTION

It is therefore an object of the present invention to provide an improved apparatus for cutting off a thickness of wood or veneer from wooden material such as logs or lumber which will not impair knars or areas surrounding them, in other words, to produce veneer sheets of high quality.

Another object of the present invention is to provide an improved apparatus for cutting off a thickness of wood or veneer from wooden material such as logs or lumber which facilitates effective pressing of the wooden material and which thereby produces veneer sheets of high quality and which minimizes curling of the veneer sheets.

According to the present invention, there is provided, in a generic form, an apparatus for cutting off a thickness of wood or veneer from wooden material, having a tangential knife for cutting the wooden material and a pressing device positioned ahead of the cutting edge of said tangential knife, which apparatus is improved in that said pressing device comprises a plurality of pressing members, each of said members being supported by corresponding resilient means. These pressing members preferably comprise rollers having a plurality of edged members projecting outwardly therefrom, which edged members form a plurality of small cuts in the surface of the log prior to cutting thereof.

BRIEF DESCRIPTION OF THE DRAWINGS

The objects, features and advantages of the present invention will become more apparent from the following description when noted in conjunction with the accompanying drawings in which.

DESCRIPTION

Figure 1:
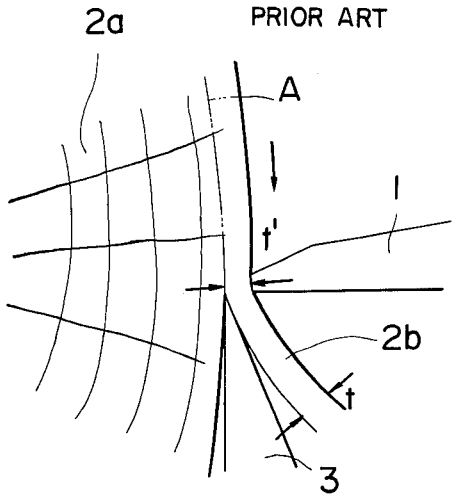
FIG. 1 PRIOR ART
FIG. 1 is a fragmentary side elevation of a prior art rotary veneer lathe.

First of all, a more detailed description of the prior art will be made by referring to FIG. 1. A log 2*a* turned on a rotary veneer lathe is pressed by a unitary pressure bar 1 while it is cut by a tangential knife 3. Said pressure bar 1 is positioned to press the log 2*a* slightly ahead of the cutting edge of the tangential knife as depicted. Log 2*a* is axially rotated in the direction of the arrow. The tangential knife engages log 2*a* and proceeds therein at a distance *t* inside the log's surface, to cut off a thickness of wood 2*b*. The two-dotted chain line A shows an imaginary line along which the cutting edge of knife 3 proceeds as log 2*a* axially rotates. Pressure bar 1, on the other hand, presses log 2*a* with a predetermined force. The portion at which log 2*a* is pressed is about 20% of the intended veneer thickness *t* ahead of the cutting edge of knife 3. When thus pressed, the log is strained so that distance *t'* between the pressed point on the log's surface and the two-dotted chain line A is about 95% of the intended veneer thickness *t*. In this case, it is known that a strain of 0.05 is created on the pressed area. Thereafter, the cut-off wood 2*b* expands back to obtain the intended veneer thickness *t*.

Next, descriptions of the preferred embodiment directed to overcome the drawbacks of the prior art will be made.

Figure 2:
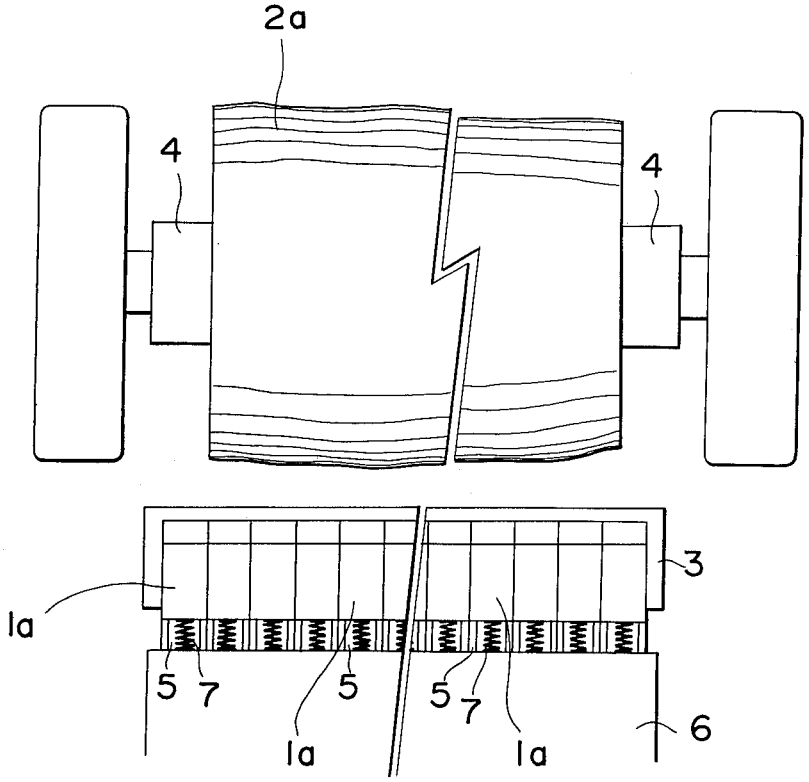
FIG. 2 is a partly omitted plan view of a rotary veneer lathe representing a preferred embodiment of the present invention.
Figure 3:
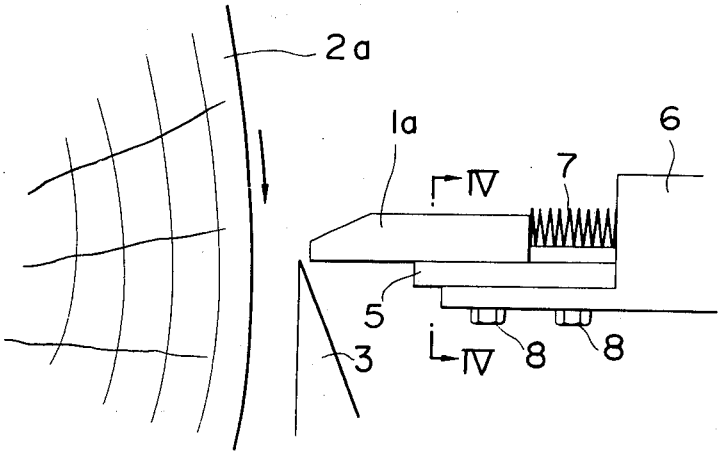
FIG. 3 is a fragmentary side elevation of the veneer lathe shown in FIG. 2.
Figure 4:
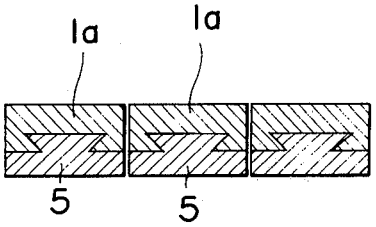
FIG. 4 is a section taken on line IV—IV of FIG. 3.

Referring to FIGS. 2 through 4, log 2*a* is axially held by a pair of chucks at both log ends and is adapted to be driven by an appropriate power source (not shown), to rotate axially in the direction of the arrow. In the proximity of the thus held log, there is provided a device for cutting off a thickness of wood from the log. The structure of the device is as follows. Block 6 is disposed substantially at right angles with a tangent line on the periphery of log 2a. Said block has a notch defined by a horizontal surface and a perpendicular surface, and is adapted to move back and forth in a radial direction with respect to log 2a. On said horizontal surface of block 6, there are provided a plurality of supports 5 aligned, with equal spacing therebetween, in an axial direction with respect to log 2a, and fastened by bolts 8. As shown in FIG. 4, a plurality of nose bars 1a are slidably engaged with said supports 5 in a one-to-one correspondence. Between said perpendicular surface of the notch and each nose bar 1a there is provided a spring 7. One end of said spring 7 is fastened to said nose bar, and the other end thereof is fastened to the perpendicular surface of the notch of block 6. Substantially perpendicular to said nose bars, there is provided the tangential knife 3. The edge of said knife 3 is apportioned to the proximity of the nose bar ends. Block 6, having supports 5 and nose bars 1a provided thereon, is adapted to move in a longitudinal direction while maintaining its perpendicular relation with tangential knife 3. The edge of knife 3 is as long as the axial length of log 2a. Springs 7 have a spring constant sufficient to cause an approximate strain of 0.05 on the log, as described in the description of the prior art. This must be a portion without knars, and block 6 must be moved with a predetermined force toward log 2a to cause said nose bars to press against the log's surface. However, said spring constant is not strong enough to strain a knar.

Figure 5:
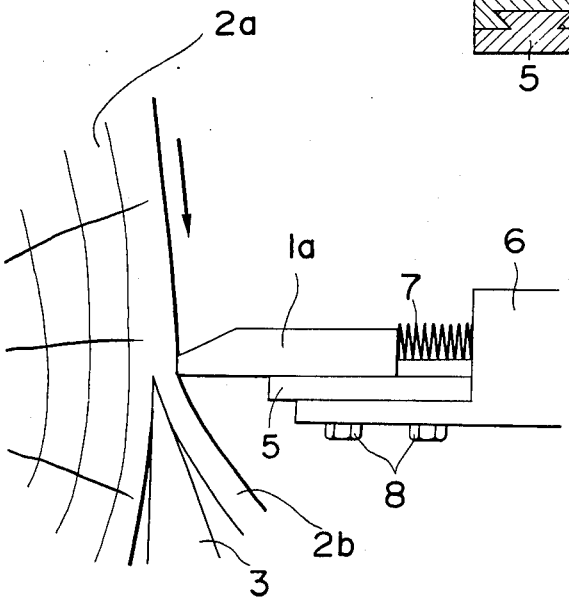
FIG. 5 is a side elevation of the veneer lathe of FIG. 3 which is in the operative or cutting position.
Figure 6:
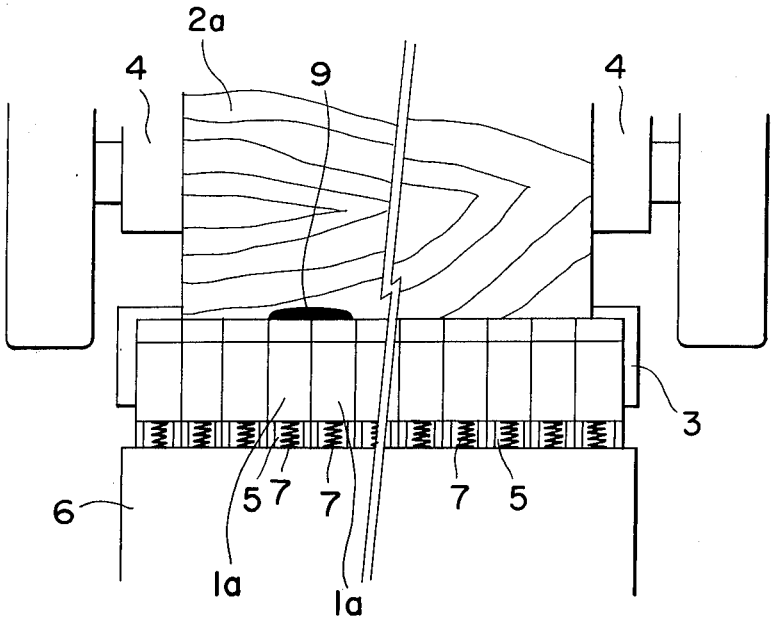
FIG. 6 is a plan view of the operating lathe of FIG. 5.

The cutting operation by the present device is as follows. The device is set in such a position that the array of nose bars 1a faces rotating log 2a, and the edge of tangential knife 3 engages and cuts into said rotating log 2a. Then, the block 6 is moved gradually toward the cutting edge. As a result, the array of nose bars 1a presses the log's surface at a portion slightly ahead of the cutting edge as depicted in FIG. 5. At this time, springs 7 between each nose bar 1a and the perpendicular surface of the notch of block 6 are compressed to exert pressure on the pressed log's surface by way of a corresponding nose bar. Pressure thus exerted on log 2a creates a strain of approximately 0.05 on the pressed area. During the above-mentioned cutting operation, nose bars 1a often come upon one or more knars. In FIG. 6, two neighboring nose bars are shown encountering a knar 9. However, pressure generated by springs 7 is not large enough to strain knar 9 due to the spring's predetermined spring constant. Consequently, said two nose bars do not damage the hard and fragile knar. Since knars rarely crack during the cutting operation, it is not detrimental to the prevention of cracks in the log that knar 9 is hardly strained in the cutting operation. On the other hand, the remaining portion of log 2a is prevented from being cracked due to the pressure exerted thereon by the remaining nose bars 1a. As a result, veneer sheets of high quality are obtained.

Further, a log usually bears irregularities on its periphery until the cutting work proceeds to provide the log with an exact cylindrical shape. However, nose bars 1a are supported by springs 7 which move resiliently with respect to the log's surface, independently of each other.

Therefore, pressure can be applied over the axial length of log 1a from the start of the cutting operation despite the presence of irregularities on the log's surface.

Figure 7:
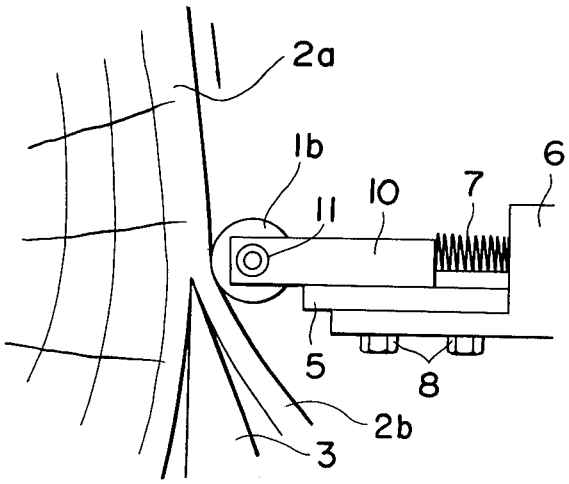
FIG. 7 is a fragmentary side elevation of a rotary veneer lathe representing another embodiment of the present invention.
Figure 8:
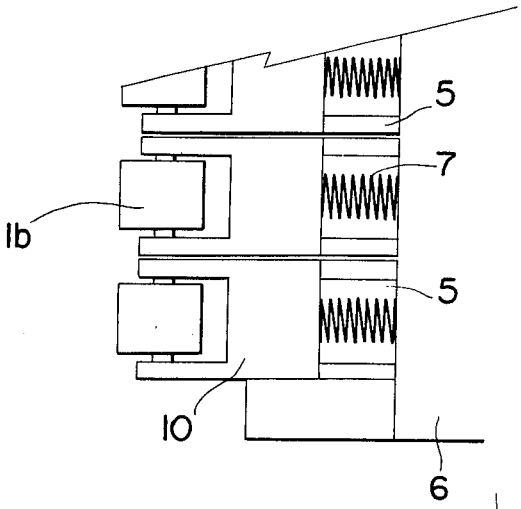
FIG. 8 is a plan view of a pressing means employed in the lathe arrangement of FIG. 7.

Another embodiment of the device according to the present invention is illustrated in FIGS. 7 and 8. In this embodiment nose bars 1a used in the first embodiment are replaced by pressure rollers 1b. Roller supports 10 are slidably provided on corresponding supports 5 in the same manner as described in conjunction with FIG. 4. Said roller supports 10 are provided with rotatable pressure rollers 1b at their ends by means of bearings 11. The other parts and elements are essentially similar to those included in the first embodiment. Therefore, they will not be described further here. An advantageous feature of the second embodiment as shown in FIGS. 7 and 8 is that the friction force caused by the pressing means onto log 2a is noticeably reduced. This permits the least possible power to be used to drive chucks 4 (FIG. 2) which are gripping log 2a at its ends.

Figure 9:
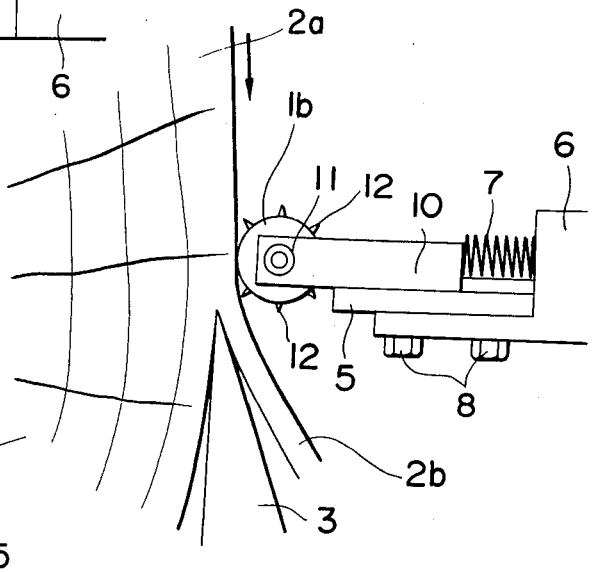
FIG. 9 is a fragmentary side elevation of still another embodiment of the present invention.
Figure 10:
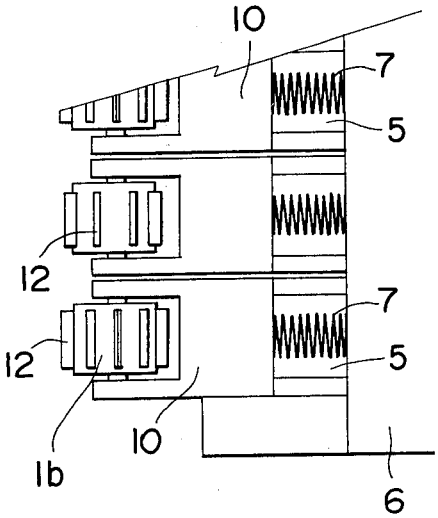
FIG. 10 is a plan view of a pressing means employed in the lathe arrangement of FIG. 9.
Figure 11:
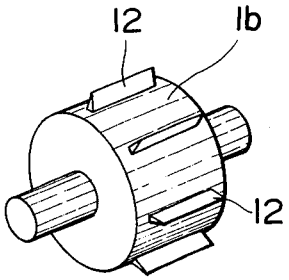
FIG. 11 is a perspective view of an edged roller forming part of the pressing means shown in FIG. 9.
Figure 12:
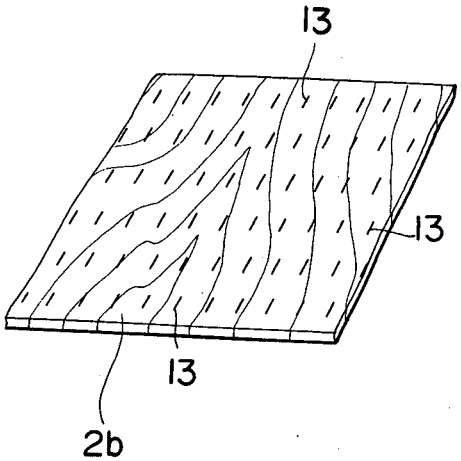
FIG. 12 is a perspective view of a veneer sheet cut off from a log by the lathe shown in FIG. 9–11.

Another embodiment of the device according to the present invention is shown in FIGS. 9–11. This embodiment is also similar to the two preceding embodiments except for the arrangement concerning the pressing means. Roller supports 10 are slidably provided on corresponding supports 5 in the same manner as those of the second embodiments. Said roller supports are provided with freely rotatable pressure rollers 1b by means of bearings 11. Each roller 1b has a number of projecting edged members 12 on its periphery, parallel to the log axis. The rollers 1b press log 2a at a portion ahead of and substantially distant from the cutting edge of the tangential knife 3. In other words, in this arrangement, roller 1b and knife 3 do not hold wood 2b therebetween. In the operation of this embodiment, block 6 is advanced toward log 2a to press roller 1b against the log surface. At the same time, knife 3 engages and cuts into log 2a which is being turned, thus cutting off a thickness of wood 2b. As in the preceding embodiments, knars encountered by rollers 1b during the cutting operation are successfully prevented from being marred due to the resiliency effect of springs 7 which have a predetermined spring constant. Moreover, edge members 12 provided on respective rollers 1b serve to form a number of cuts on the log surface as shown in FIG. 12, when rollers 12 are pressed against the log's surface. As a result, cut-off veneer sheets are relatively soft and remain substantially flat instead of being curled, after they are cut off by tangential knife 3.

Figure 13:
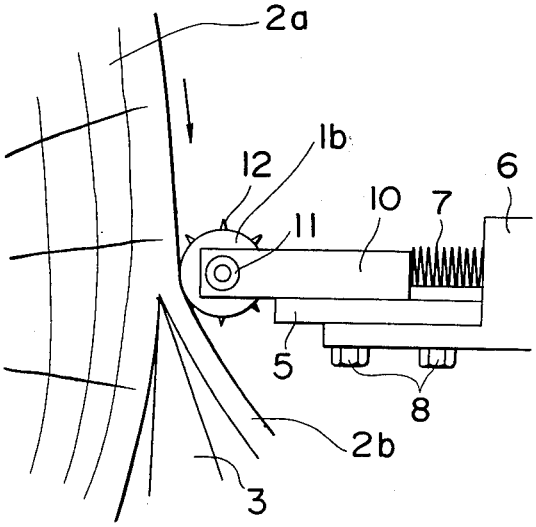
FIG. 13 is a side elevation similar to FIG. 9 but shows a modified position of the roller, relative to the cutting edge of the tangential knife.

The flat veneer sheets thus produced can be fed directly to the next treatment process by means of a suitable conveyor system. In other words, it is possible to omit manual labor such as troublesome flattening work. Since they are flat, it is also possible to stack these veneer sheets in orderly piles in a limited floor space. In this way, labor saving is realized, increasing productivity. In this embodiment, roller 1b may be positioned to press log 2a at a portion only slightly ahead of knife 3 which proceeds through the log as can be seen in FIG. 13. In this position, the thickness of wood 2b cut off from log 2a is sandwiched between roller 1b and knife 3.

The pressing means in the forms described above are applicable not only to a rotary veneer lathe, but to a known veneer slicer in which a knife and a pressing means are adapted to move reciprocally, relative to stationary lumber. The springs for exerting a resilient reaction force onto a log may be replaced by any other suitable resilient means.

It may now be understood from the above description that a device according to the present invention enables the cutting-off of thicknesses of wood from a log without marring knars when pressed, thus ensuring a desirable veneer quality.

It will also be recognized that a log having an uneven surface can be pressed over the axial length of the log in the neighborhood of the portion where it is being cut contributing to the improvement of veneer quality.

What is claimed is:

1. In an apparatus for cutting off a thickness of wood or veneer from a wooden loglike member, said apparatus having a tangential knife for cutting the wooden member and a pressing device positioned ahead of the cutting edge of said knife, the improvement wherein said pressing device comprises a plurality of pressing members, resilient means individually urging each of said pressing members into engagement with the surface of said wooden member, each said pressing member comprising a roller, and means associated with each said roller for making small cuts on the surface of the wooden member, said means comprising a plurality of edged members provided on the peripheral surface of each said roller.

2. An apparatus according to claim 1, wherein said plurality of edged members are spaced circumferentially around the respective roller, and said edged members being elongated in the axial direction of the respective roller.

3. An apparatus according to claim 1, wherein said plurality of rollers are disposed closely adjacent one another and are aligned substantially in a row so that said rollers contact the surface of the wooden member at predetermined spaced intervals over substantially the full length thereof.

4. An apparatus according to claim 3, wherein each of said rollers is rotatably mounted on a support member which is slidably supported for movement in a direction which extends substantially radially of said wooden member, and said resilient means comprising spring means coacting with said support member for resiliently urging same radially inwardly toward the surface of said wooden member.

5. An apparatus according to claim 1, wherein said rollers contact the surface of said wooden member at a location which is spaced a substantial distance ahead of the cutting edge of said knife.

* * * * *